US011117246B2

(12) United States Patent
Whitehead

(10) Patent No.: US 11,117,246 B2
(45) Date of Patent: Sep. 14, 2021

(54) TRUCK ANCHOR PIN BUSHING DRIVER

(71) Applicant: Lisle Corporation, Clarinda, IA (US)

(72) Inventor: Michael L. Whitehead, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 55 days.

(21) Appl. No.: 16/674,234

(22) Filed: Nov. 5, 2019

(65) Prior Publication Data

US 2020/0171634 A1 Jun. 4, 2020

Related U.S. Application Data

(60) Provisional application No. 62/773,840, filed on Nov. 30, 2018.

(51) Int. Cl.
*B25B 13/00* (2006.01)
*B25B 27/02* (2006.01)
*B25B 27/04* (2006.01)

(52) U.S. Cl.
CPC ..... *B25B 27/026* (2013.01); *B25B 27/04* (2013.01)

(58) Field of Classification Search
CPC ..... B25B 21/00; B25B 19/00; B25B 21/007; B25B 21/023; B21D 1/00; B21D 1/065; B21D 5/00; B21D 7/00
See application file for complete search history.

(56) References Cited

U.S. PATENT DOCUMENTS 2,145,725 A * 1/1939 Jamieson ..... B26F 1/3846 30/366
2,860,535 A * 11/1958 Fowler ..... F16B 43/001 81/8.1
3,209,445 A * 10/1965 Moskovitz ..... B23P 11/02 29/275
5,048,379 A 9/1991 Gramera et al.
6,415,492 B1 7/2002 Jamison
D477,763 S * 7/2003 Hebert ..... D8/70
7,707,709 B2 * 5/2010 Whitehead ..... B25B 27/06 29/724
2020/0171634 A1 * 6/2020 Whitehead ..... B25B 27/026

OTHER PUBLICATIONS

28890 Anchor Pin Bushing Remover Lisle Corporation 3 pages.
AJAX Tools Part #1166 2014 3 pages.
Bosch Automotive Service Solutions Inc. OTC Tools Brake Anchor Pin and Bushing Service Set SKU 5038 3 pages.

* cited by examiner

*Primary Examiner* — Lee D Wilson
(74) *Attorney, Agent, or Firm* — Banner & Witcoff, Ltd.

(57) ABSTRACT

A tool for use in combination with an air hammer for removing and/or installing an anchor pin bushing. The tool includes a drive shaft and an adaptor that is removably attachable to the drive shaft. A first end of the drive shaft is configured for removable attachment to an air hammer. A second end of the drive shaft is configured for removable attachment with the adaptor. The adaptor includes a flanged end and a notched end. Both the flanged end and notched end include a counterbore sized and configured to fit over an anchor pin. The notched end of the adaptor is used for removing an anchor pin bushing and the flanged end of the adaptor is used to install an anchor pin bushing.

4 Claims, 6 Drawing Sheets

TRUCK ANCHOR PIN BUSHING DRIVER

CROSS REFERENCE TO RELATED APPLICATION

This application is a utility application based on Ser. No. 62/773,840 filed Nov. 30, 2018 entitled "Truck Anchor Pin Bushing Driver" for which priority is claimed.

TECHNICAL FIELD

An automotive repair tool for removing and installing truck and trailer brake anchor pins and anchor pin bushings.

BACKGROUND OF THE INVENTION

In a principal aspect the present invention relates to a tool used by automotive repair mechanics and service personnel. In particular, the invention may be used in combination with a pneumatically driven air hammer to remove seized anchor pins and bushings or to install an anchor pin bushing. The invention may also be used to remove bushings from truck leaf springs.

When repairing automobiles, machinery or other items, a mechanic or technician typically requires multiple sets and types of tools, including wrenches, for removal of or attachment of bolts, screws, nuts and other fasteners. When servicing a truck's brake system, tools may be needed for removing and/or installing anchor pins and/or anchor pin bushings from a housing. Typically, bushings are press fit into a housing and an anchor pin is slip fit into the bushing. The anchor pin should freely rotate within the bushing. When the anchor pin does not freely rotate within the bushing, which is called a seized anchor pin, the anchor pin needs to be removed. Often, a seized anchor pin will also require the removal of the anchor pin bushing.

Existing anchor pin tools exist to remove and install anchor pins and bushings, but none of them have the particular tool configuration of the present invention. In particular, prior art tools used one driver for removing an anchor pin and a different driver for installing the anchor pin. In some existing embodiments, the installation tool consisted of a single-piece tool and the removal tool consisted of a different single-piece tool consisting of a removal driver and drive shaft. In another embodiment, the differently-sized drivers were thread screwed onto one end of a driver shaft and the other end was connected to a pneumatically driven air hammer. Threading and unthreading the cones from the shaft was cumbersome and inefficient. Drivers not properly threaded to the shaft could break in operation. Additionally, vibrations from the air hammer could cause the driver to loosen or unthread which could lead to the tool breaking in operation. One or more of the removal and insert drivers could easily be misplaced amongst other devices such as sockets leading to inefficiencies in the repair of truck and trailer brake systems. Another existing tool design for removing anchor pins and/or bushings is a C-frame tool that is placed over an anchor pin and bushing housing and an anvil with a threaded stem is screwed to remove the anchor pin. In order to remove the bushing, an adaptor is added to the anvil to increase the diameter of the anvil and remove the bushing. The C-frame tool is costly and its design leads to inefficiencies in the repair of truck and trailer brake systems.

SUMMARY OF THE INVENTION

Briefly the present invention is a tool to be used in combination with a pneumatically driven air hammer for the quick and efficient removal and installation of anchor pins from bushings found in truck and trailer brake systems.

Thus, it is an object of the invention to provide an elongated drive shaft configured on a first end to attach to a pneumatically driven air hammer and configured on a second end for quick attachment to a reversible adaptor. One end of the reversible adaptor includes a notched end for removing a bushing and the other end of the reversible adaptor includes a flanged end for installing a bushing.

It is another object, advantage and feature of the invention to provide a conical shaped counterbore in the flanged end of the adaptor and a conical shaped counterbore in the notched end, wherein each counterbore is adapted to receive the second end of the elongated drive shaft.

It is a further object of the invention that the second end of the elongated drive shaft include a friction fitting adapted to quickly connect and disconnect the adaptor from the drive shaft.

These and other objects, advantages and features of the invention are set forth in the detailed description which follows.

BRIEF DESCRIPTION OF THE DRAWINGS

In the detail description reference will be made to the drawing comprised of the following Figures.

DETAILED DESCRIPTION OF AN EMBODIMENT OF THE INVENTION

Figure 1:
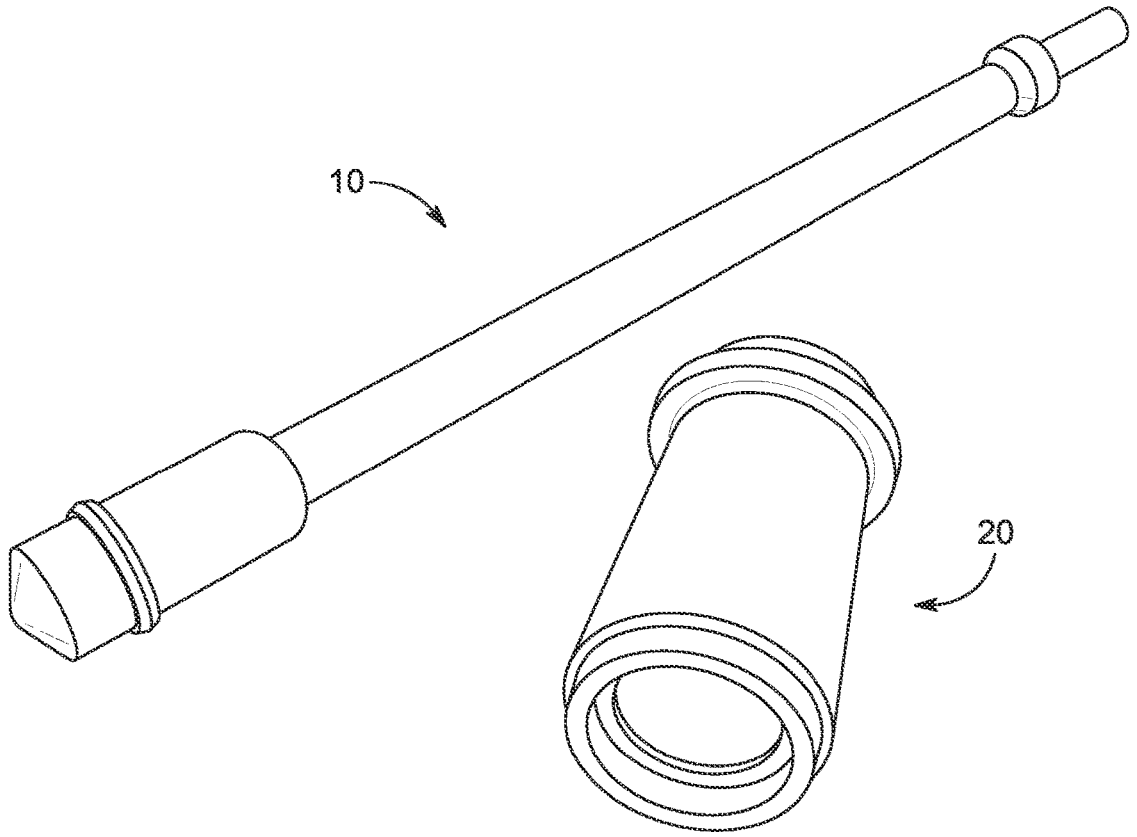
FIG. 1 comprises a photograph depicting the component parts of the anchor pin bushing tool, including an elongated drive shaft and an adaptor.

Referring to FIG. 1, the component parts of the invention are an elongated drive shaft 10 and an adaptor 20.

Figure 2:
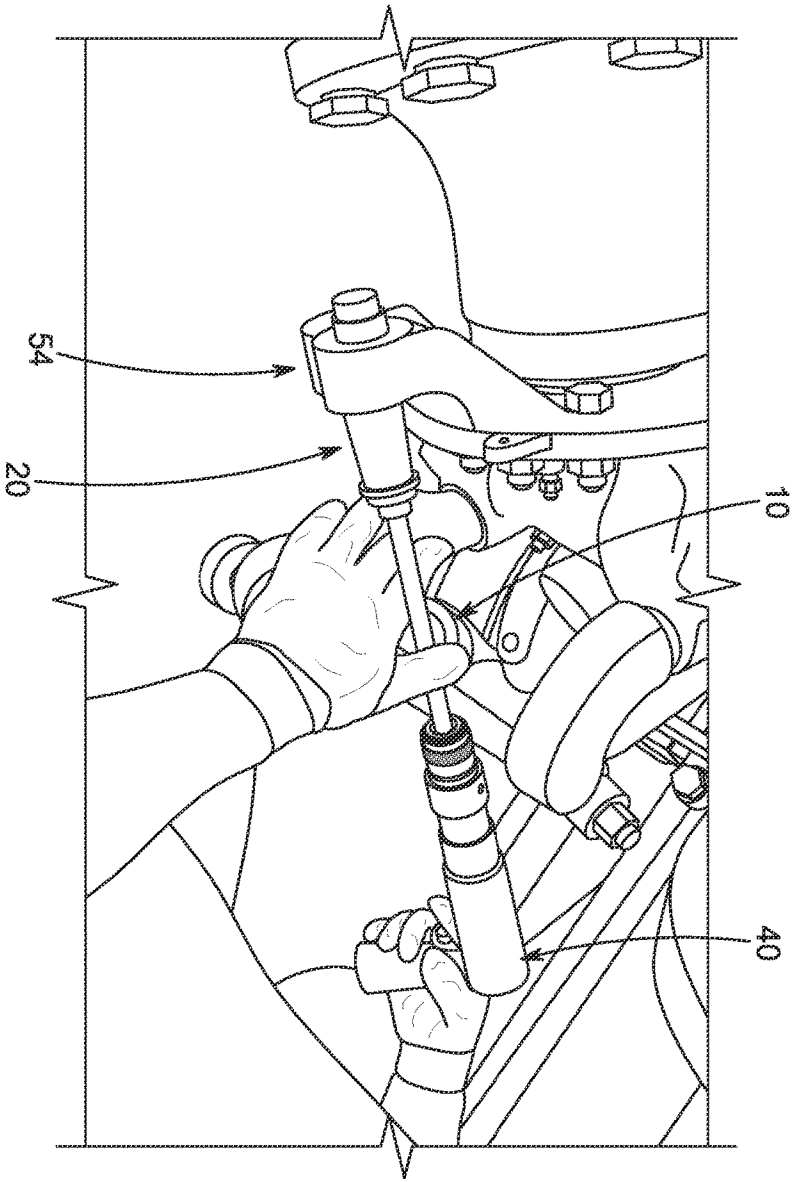
FIG. 2 comprises a photograph of the assembled tool connected to pneumatically driven air hammer and an anchor pin located within a bushing on a brake frame housing.
Figure 3:
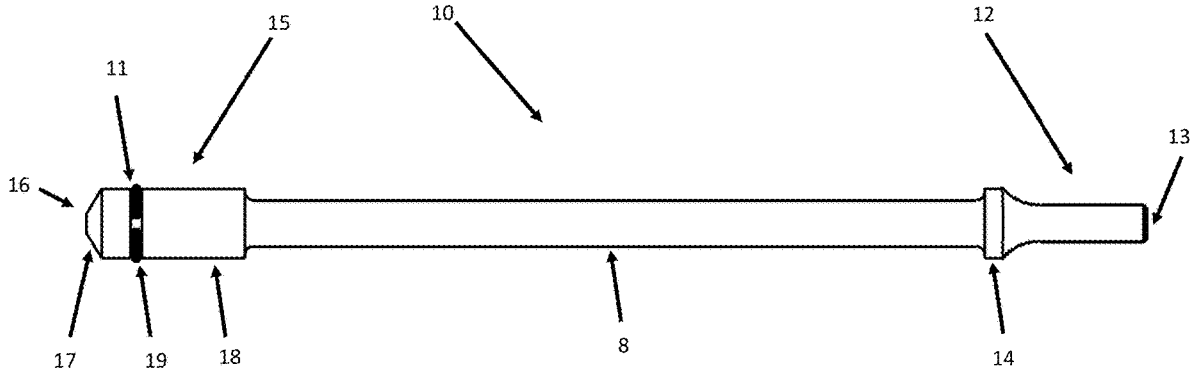
FIG. 3 is a view of the elongated drive shaft of the invention.

Referring to FIG. 1 and FIG. 3, the drive shaft 10 has a first section 12 having a generally cylindrical shape. The length and diameter of the first section 12 of the drive shaft 10 is sized and configured for attachment to a pneumatically driven air hammer 40. FIG. 2 illustrates the drive shaft 10 connected to an air hammer 40 in operation. The first section 12 begins at a first distal end 13 of the drive shaft 10 and terminates at flange 14 located inward from the distal end 13. The flange 14 has a length direction along the axial length of drive shaft 10. The flange 13 preferably has a diameter greater than the diameter of the first section 12.

The drive shaft 10 includes a second section 15 located at a second distal end 16 of the drive shaft 10. The second section 15 has a generally cylindrical shape and circular cross-section. The second section 15 includes a tapered portion 17 at the second distal end 16 of drive shaft 10, a generally uniform cross-section portion 18, and a recessed portion 19. The tapered portion 17 is preferably conical or frustoconical in shape. The recessed portion 19 is located inward of the tapered portion 17, said recessed portion 19 sized and configured to accommodate a retainer clip 11. The retainer clip 11 permits the drive shaft 10 to be removably attachable and detachable from the adaptor 20, while also providing a secure coupling during use of the tool. The retainer clip 11 provides a friction fit of the drive shaft 10 to the adaptor 20. Preferably, the retainer clip 11 is a "C" ring. The generally uniform cross-section portion 18 is preferably located inward of said recessed portion 19.

The drive shaft 10 includes a third section 8 located between the first section 12 and the second section 15. The third section 8 is preferably cylindrically shaped and has a generally circular cross-section. The diameter of the third section 8 is preferably greater than the diameter of the first distal end 13, less than the diameter of the flange 14, less than the diameter of the retainer clip 11 and less than the diameter of the generally uniform cross-section 18 of the second section. Although the first section 12, second section 15 and third section 8 of the tool preferably have a generally circular cross-section, the cross-section may have other geometries such as hexagonal, octagonal, etc. without departing from the invention.

Figure 4:
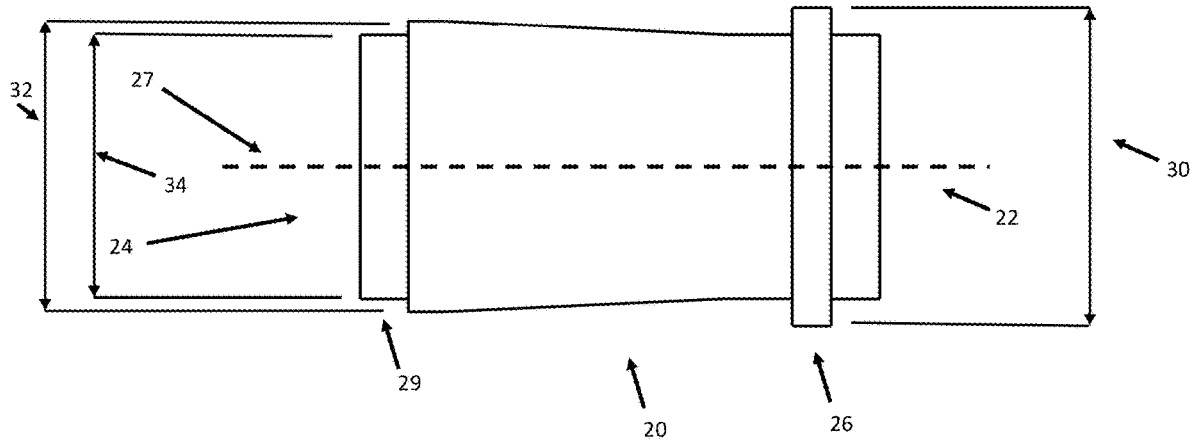
FIG. 4 is a view of the adaptor of the invention.
Figure 5:
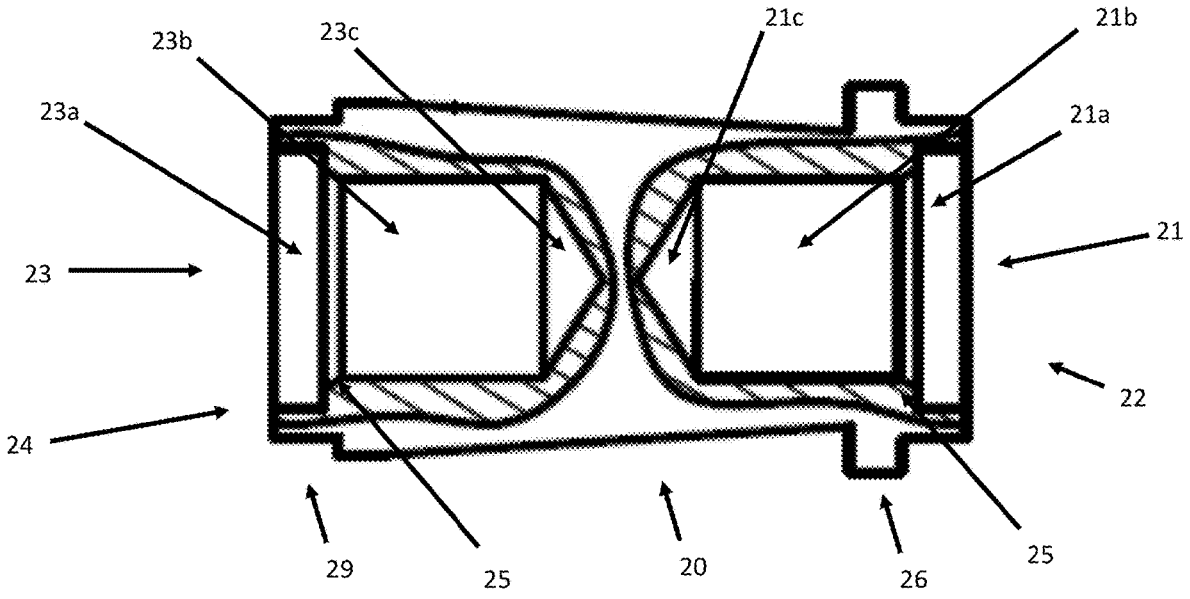
FIG. 5 is a cross-sectional view of adaptor of the invention.

Referring to FIGS. 4 and 5, adaptor 20 is removably attachable to the drive shaft 10. The adaptor 20 has a straight, centerline axis 27. In particular, the adaptor 20 has a flanged end 22 and a notched end 24.

Figure 6:
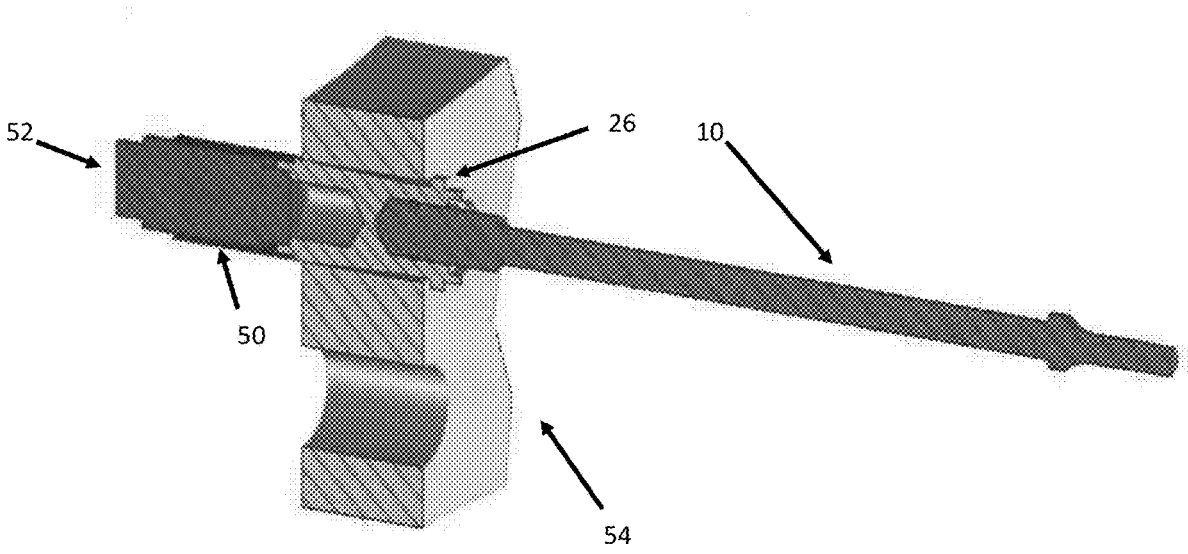
FIG. 6 is a cross-sectional view of the assembled tool being used to remove an anchor pin and anchor pin bushing from a housing.

The flanged end 22 of the adaptor 20 includes a flange 26. The flange 26 has an outer diameter 30 preferably greater than the outside diameter of the bushing in which the anchor pin will be installed or removed. A flange having an outer diameter greater than the outside diameter of the anchor pin bushing 50 will stop the assembled tool from going through the housing 54 after the anchor pin 52 and/or anchor pin bushing 50 have been removed, as is shown in FIG. 6.

The notched end 24 of the adaptor 20 includes a notch 29. The notched end 24 has an outer diameter 32 and an inner diameter 34. The outer diameter 32 is preferably smaller than the outside diameter of the bushing into which the anchor pin is installed or removed. The inner diameter 34 is preferably smaller than the innermost diameter of the bushing into which the anchor pin is installed or removed. The notched end 24 of the adaptor 20 is used for removing an anchor pin and bushing from a housing 54. Preferably, the outer diameter of the adaptor decreases from the diameter 32 to the flange 26 as shown in FIG. 4. The tapered, conical, outer diameter of the adaptor 20 aids in removal of the tool after a bushing has been driven out of the housing. Most preferably, the portion of the adaptor 20 between the diameter 32 and the flange 26 is conical to allow for clearance should an external obstacle prevent proper alignment to the anchor pin and bushing.

The flanged end 22 of the adaptor 20 includes a first counterbore 21 having a generally circular cross-section. Preferably, the center of the first counterbore 21 is coaxial with the centerline axis 27. First counterbore 21 preferably includes a first section 21*a*, a second section 21*b*, and a third section 21*c*. The first section 21*a* is sized and configured to fit onto an anchor pin in operation. The second section 21*b* of counterbore 21 is sized and configured to removably attach to the second section 15 of the drive shaft 10. The second section 21*b* preferably has a generally uniform and circular cross-section. Preferably, counterbore 21 includes a chamfer 25 connecting the first section of counterbore 21*a* and the second section 21*b* of the counterbore. Most preferably, the chamfer 25 is 60 degrees. The chamfer 25 allows for a retainer clip 11 to easily be slid into the second section 21*b*. The third section 21*c* of counterbore 21 is preferably tapered such that the diameter of the counterbore in the third section 21*c* decreases towards the interior of the adaptor 20 along its longitudinal axis. Preferably, the third section 21*c* has a conical or frustoconical shape. The third section 21*c* of counterbore 21 is sized and configured to receive the tapered end 17 of the drive shaft 10.

The notched end 24 of the adaptor 20 includes a second counterbore 23 having a generally circular cross-section. Preferably, the center of the second counterbore 23 is coaxial with the centerline axis 27. Second counterbore 23 preferably includes a first section 23*a*, a second section 23*b*, and a third section 23*c*. The first section 23*a* is sized and configured to fit onto an anchor pin in operation. The second section 23*b* of counterbore 23 is sized and configured to removably attach to the second section 15 of the drive shaft 10. The second section 23*b* preferably has a generally uniform and circular cross-section. Preferably, second counterbore 23 includes a chamfer 25 connecting the first section of counterbore 23*a* and the second section 23*b* of the counterbore. Most preferably, the chamfer is 60 degrees. The chamfer 25 allows for a retainer clip 11 to easily be slid into the second section 23*b*. The third section 23*c* of counterbore 23 is preferably tapered such that the diameter of the counterbore in the third section 23*c* decreases towards the interior of the adaptor 20 along its longitudinal axis. Preferably, the third section 23*c* has a conical or frustoconical shape. The third section 23*c* of counterbore 23 is sized and configured to receive the tapered end 17 of the drive shaft 10.

As shown in FIG. 2, a pneumatically driven air hammer is connected to the first distal end 13 of the drive shaft 10. The second section 15 of the drive shaft 10 is inserted into either the first counterbore 21 or the second counterbore 23 of the adaptor 20, depending on whether the operator desires to install or remove an anchor pin bushing. The configuration of the second section 15 of the drive shaft 10 and the counterbores 21 and 23 permits the drive shaft 10 to be removably attachable from the adaptor 20. Once the drive shaft 10 and adaptor 20 are coupled, the tool may be placed onto an anchor pin and for removal or installation of an anchor pin and/or anchor pin bushing.

The second distal end 16 of the drive shaft 10 is thus designed to engage and effectively interlock with the adaptor 20 by insertion of the second distal end 16 with either the first counterbore 21 or the second counterbore 23 depending upon whether the anchor pin bushing is to be installed or removed from a housing.

Thus, the combination of a drive shaft 10 and reversible adaptor 20, enables by its design a tool which can be easily used to both install and remove anchor pins and/or anchor pin bushings in an efficient and timely manner thereby overcoming the shortcomings of prior art tools.

A benefit of the design is the feature of using a single adaptor wherein the installation end of the member and the removal end are coaxial. This insures uniform application of the axial force to remove and install an anchor pin bushing. The adaptor may be customized in size to accommodate anchor pin bushings of various size and a set of such custom sized adaptors may be provided.

While there has been set forth an embodiment of the invention, it is to be understood that the invention shall be limited only by the following claims and equivalence thereof.

What is claimed is:

1. A tool for use in combination with an air hammer for removing and installing an anchor pin bushing, said tool comprising:

a drive shaft having a first section at a first end of said shaft, and a second section at a second end of said shaft, said first section begins at a first distal end of the drive shaft and terminates at a flange located inward from the distal end, wherein said first end is removably attachable to an air hammer, said second section includes a tapered portion at a second distal end of the drive shaft, and a recessed portion located inward of said tapered portion, a clip within the recessed portion of said second section, an adaptor, said adaptor having a centerline axis, said adaptor having a flanged end and a notched end, said flanged end including a flange, said notched end of said adaptor including a notch, said flanged end having a first counterbore coaxial with said centerline axis, said notched end having a second counterbore coaxial with said centerline axis, wherein at least a portion of said first counterbore and said second counterbore include a chamfer, wherein said first and second counterbore are removably attachable to said second distal end of said drive shaft.

2. The tool of claim 1 wherein the first and second counterbores of the cylindrical member each comprise a cylindrical coaxial equal diameter section configured to receive and engage the distal drive end.

3. The tool of claim 1 wherein the flanged end and notched end of the cylindrical member each comprise an annular coaxial circular surface having a substantially equal diameter.

4. The tool of claim 2 wherein the flanged end and notched end of the cylindrical member each comprise an annular coaxial circular surface having a substantially equal diameter.

* * * * *